United States Patent [19]

Goutte et al.

[11] 4,087,267

[45] May 2, 1978

[54] CONTROLS FOR USE IN FIBERIZATION SYSTEMS EMBODYING MEANS FOR SUPPRESSION OF POLLUTION

[75] Inventors: Rene Goutte, Tokyo, Japan; Jean A. Battigelli, Rantigny; Marie-Pierre Barthe, Clermont, both of France

[73] Assignee: Saint-Gobain Industries, Neuilly-sur-Seine, France

[21] Appl. No.: 747,397

[22] Filed: Dec. 30, 1976

[30] Foreign Application Priority Data

Oct. 22, 1976 France ..... 76 31860

[51] Int. Cl.[2] ..... C03B 37/04

[52] U.S. Cl. ..... 65/5; 65/6; 65/9; 65/14; 65/29; 156/62.4; 264/6; 264/121; 425/8; 425/83.1; 425/83;8

[58] Field of Search ..... 6/2, 3 C, 9, 5, 6, 29, 6/14, 16, 161; 264/6, 121; 156/62.4

[56] References Cited

U.S. PATENT DOCUMENTS

| | | | |
|---|---|---|---|
| 2,317,895 | 4/1943 | Drill | 65/5 |
| 3,347,648 | 10/1967 | Krakauer et al. | 65/6 X |
| 3,442,633 | 5/1969 | Perry | 65/5 X |
| 3,671,210 | 6/1972 | Richardson | 65/16 X |
| 3,762,896 | 10/1973 | Borst | 65/29 X |
| 3,865,540 | 2/1975 | Loeffler | 65/3 C X |
| 3,877,911 | 4/1975 | Borst | 65/3 C |
| 3,883,334 | 5/1975 | Cassidy et al. | 65/9 X |
| 3,887,648 | 10/1967 | Krakauer et al. | 65/6 X |
| 4,052,183 | 10/1977 | Levegue et al. | 65/3 C |

*Primary Examiner*—Robert L. Lindsay, Jr.
*Attorney, Agent, or Firm*—John T. Synnestvedt

[57] ABSTRACT

System for suppression of pollution in fiber attenuating operations, especially in mineral fiber insulation blanket production. The system disclosed provides gas blast attenuation of the attenuable material in a fiber forming chamber and for recirculation of attenuating gases and for discharge of a portion of the gases by means of a controllable blower. The operation of the blower is regulated by a pressure sensor responsive to the pressure in the forming section.

9 Claims, 5 Drawing Figures

CONTROLS FOR USE IN FIBERIZATION SYSTEMS EMBODYING MEANS FOR SUPPRESSION OF POLLUTION

Systems for mineral fiber manufacture incorporating means for suppression of pollution are disclosed in U.S. application Ser. No. 456,878, filed Apr. 1, 1974 and in corresponding French Pat. No. 2,247,346 and U.S. Pat. No. 4,052,183, granted Oct. 4, 1977. Such systems are also disclosed in U.S. application Ser. No. 557, 281, filed Mar. 11, 1975. In these prior applications pollution suppression techniques are disclosed as applied to a variety of techniques for attenuation of fibers from thermoplastic materials, for instance mineral materials such as glass. In general those techniques for production of the fibers involve the use of gas blast attenuation.

In a typical production plant or facility, the means for effecting gas blast attenuation of the fibers is located in or at an entrance into a forming section or chamber, frequently defined by a hood having enclosing walls, and at one boundary wall, most commonly the bottom wall, a perforated or foraminous fiber collecting device is arranged. This fiber collecting device is commonly formed by a foraminous moving belt or conveyor, and the fibers are collected on the fiber collecting device in the form of a mat or blanket.

The collection of the fibers on the foraminous collecting device is ordinarily assisted or effected by the provision of a suction chamber or chambers behind or below the collecting device, an exhaust or suction fan being connected with the suction chamber to thereby assist in developing a current of the attenuating gas, carrying the attenuated fibers from the zone of attenuation through the forming section to the collecting device. The fibers are thereby deposited as a mat or blanket on the surface of the collecting device and the gases pass through the collecting device into the suction chamber or chambers.

As disclosed in the prior applications referred to, it is also well known to spray binder material upon the fibers before they are layed up upon the collecting device, such binders commonly comprising an aqueous solution or suspension of heat hardenable binder resin material, and the formed blanket is later subjected to heating in a curing oven in order to cure or harden the resin and stabilize the formed blanket or mat. Examples of various binder materials frequently used are referred to hereinafter.

As disclosed in said prior applications it is also known to spray water upon the fibers being formed, for instance at a point in the current of gases and fibers upstream of the point where the binder is sprayed upon the fibers.

In consequence of such binder and water sprays, the current of gas passing through the foraminous collecting device entrains substantial quantities of water and also constituents of the binder materials in the form of droplets of various sizes, or in gaseous form; and in addition the current of the gases also entrains substantial quantities of small fragments of the fibers. The foregoing constituents which are entrained by the current of the attenuating gas represent pollutants having a serious adverse effect upon the environment, and this is particularly true with respect to certain of the constituents which originate from the binder material which is sprayed upon the newly formed fibers. Ordinarily, the thermoplastic minerals used for fiber formation, such as glass, require the use of high temperatures and the attenuating gas at the point where the binder material is sprayed, is also at high temperature, and in consequence various components of the binder composition or material are volatilized and, if discharged into the atmosphere, may be highly objectionable from several environmental standpoints.

Having the foregoing in mind, the prior applications above identified make provision for suppression of pollution of the kind referred to by employment of several techniques including the following:

First, a large proportion of the attenuating gas current is recirculated through a recirculation path extended from the downstream side of the collection device to and through the forming section, into which the attenuating gas blast and the fibers initially enter. In the recirculation path of the gases, the gases are washed or scrubbed by means of water sprays in order to assist in the separation of the entrained pollutants, and the sprayed gases are passed through a separator for instance a cyclone or centrifugal separator in order to remove as much of the moisture or spraying water as feasible and thereafter the gases are returned to the forming section in the region of the admission of the attenuating gas and the fibers being formed. The water sprayed on the recirculating gases is then collected and is subjected to various stages of screening and filtration in order to separate the pollutant constituents from the water, and thereafter the water is reused for spraying the recirculating gases and also for preparation of additional aqueous binder material to be sprayed upon the newly formed fibers in the forming section. Such treated water may also be used as a water spray in the forming section.

Because additional quantities of gas are normally introduced into the forming section as a result of the gas blast attenuation of the fibers being formed, a portion of the recirculating gases is diverted and discharged from the recirculation path. As disclosed in the prior applications above referred to, the portion of the recirculating gases which is thus diverted and discharged, is desirably subjected to the action of a high temperature burner in order to burn any residual organic constituents before said gases are discharged to atmosphere, and this further enhances the elimination of pollution.

In techniques of the kind briefly referred to above and described in detail in the applications above identified, the use of the various means for suppression of pollution, especially the recirculation of the current of the attenuating gas and also the separation of the pollutants from the recirculating gas, as by means of a water spray, may at times tend to introduce undesirable fluctuations in the conditions under which the fibers are formed or attenuated, and the conditions under which the fiber blanket is formed. Because of the recirculation of a large part of the gases, it is desirable to more completely enclose the forming section, than has been customary where the suppression of pollution by recirculation of the gases is not contemplated. With the more tightly enclosed forming section and where recirculation of gases is employed for the purpose of suppression of pollution, there may be tendencies for fluctuation of both the pressure and the temperature of the gas in the forming section. The pressure will vary in accordance with the quantity of the gases which are diverted and discharged from the recirculation flow path; and in addition, the temperature will vary in accordance with a number of factors including not only the quantity of gas diversion and discharge from the recirculation flow path, but also the extent of water spraying utilized for separation of pollutants from the recirculation gases, as well as the temperature of the water used for such water spraying. Still further, variation in atmospheric conditions, for example as between summer and winter, may also influence the operating conditions with respect to both pressure and temperature.

Variable factors such as those just referred to tend to alter uniformity of fiber and fiber blanket production, particularly in the fiber formation by gas blast attenuation, since uniformity of the fibers depends in part upon uniformity of the conditions of temperature and pressure. In fact, if the temperature of the gaseous current and consequently of the fiber blanket is too high, polymerization of the binder will start prematurely, i.e., in for forming section, instead of awaiting feed of the blanket into the binder curing oven. This condition tends to reduce the mechanical properties of the products, particular their resilience.

On the other hand if the temperature of the gases and consequently that of the blanket is too low, the moisture carried by the blanket increases, and this reduces the efficiency of the curing oven, and can even lead to dimensional irregularities of the manufactured products.

Pressure variations tend to adversely influence the effectiveness of the devices used to reduce the pollution in the gases discharged through the stack. A negative pressure in the formation chamber, that is a pressure below atmospheric pressure will increase the quantity of the air penetrating into the forming section and consequently the quantity of gases to be diverted from the recirculation path and discharged. This results in an increase in the quantity of pollutants ejected into the atmosphere. A positive pressure, on the other hand, leads to leakage or discharge from the formation chamber of gases not yet treated, thereby impairing the intended suppression of pollution.

With the foregoing in mind it is contemplated according to the present invention that controls be provided for maintaining substantial uniformity of the conditions prevailing in the zones of fiber attenuation and fiber blanket formation, particularly uniformity of pressure and temperature of the gases in these zones. In addition, it is further contemplated to regulate the volume of the gas in circulation.

It is also contemplated according to the present invention that the controls for temperature and pressure be adjustable in order to establish the desired pressure and temperature levels.

Several embodiments of control systems according to the invention are illustrated diagrammatically in the accompanying drawings in which.

Figure 4:
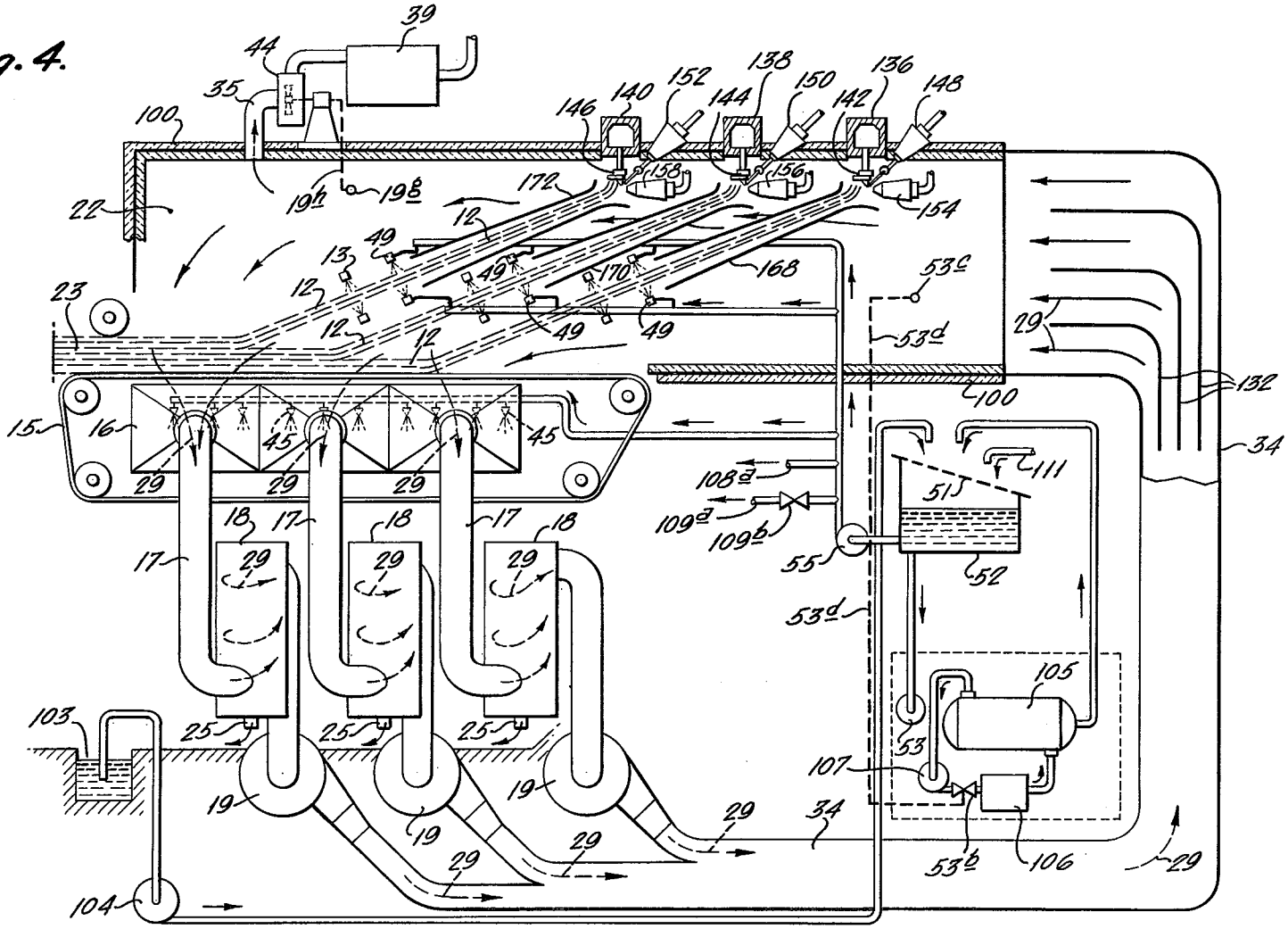
Figure 5:
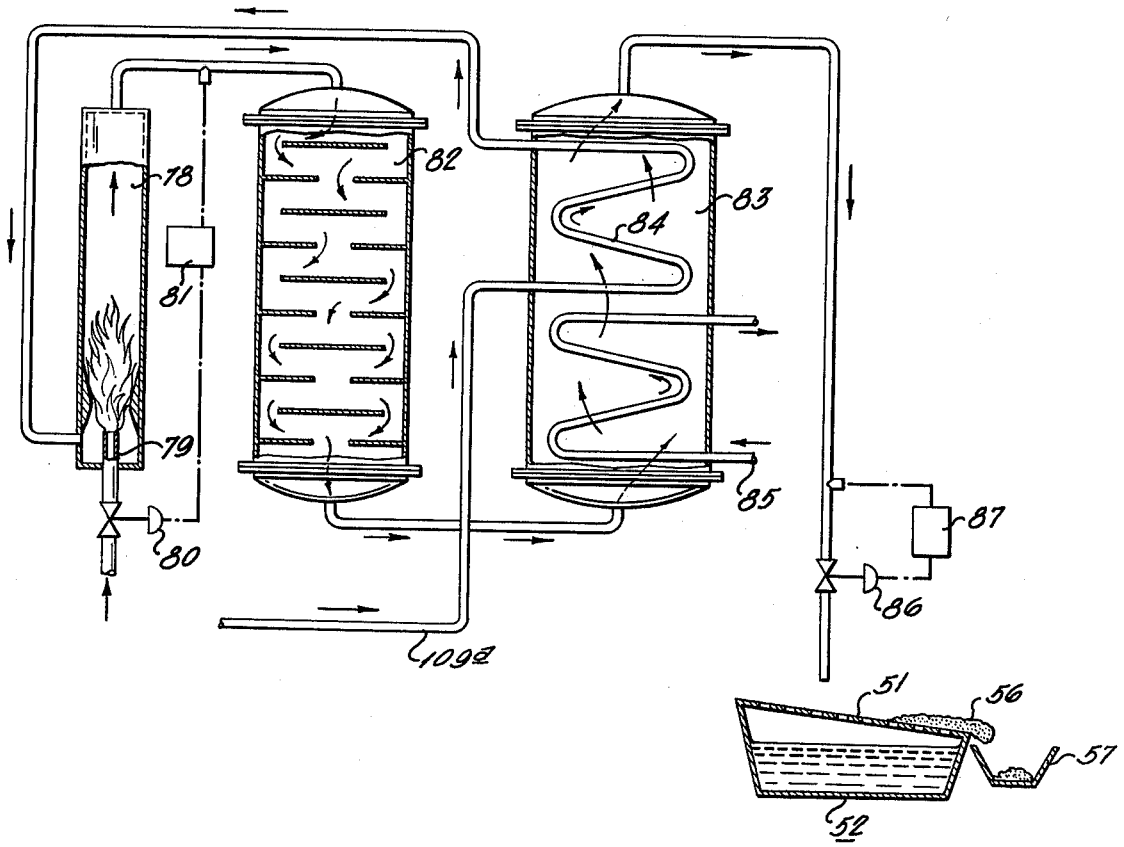

FIG. 4 schematically illustrates still another embodiment of controls according to the invention, in this instance as applied to a fiberization installation of the kind disclosed in application Ser. No. 557,281 above referred to; and FIG. 5 is a schematic view illustrating one form of system adapted to insolubilize pollutants carried by water used in the system.

Figure 1:
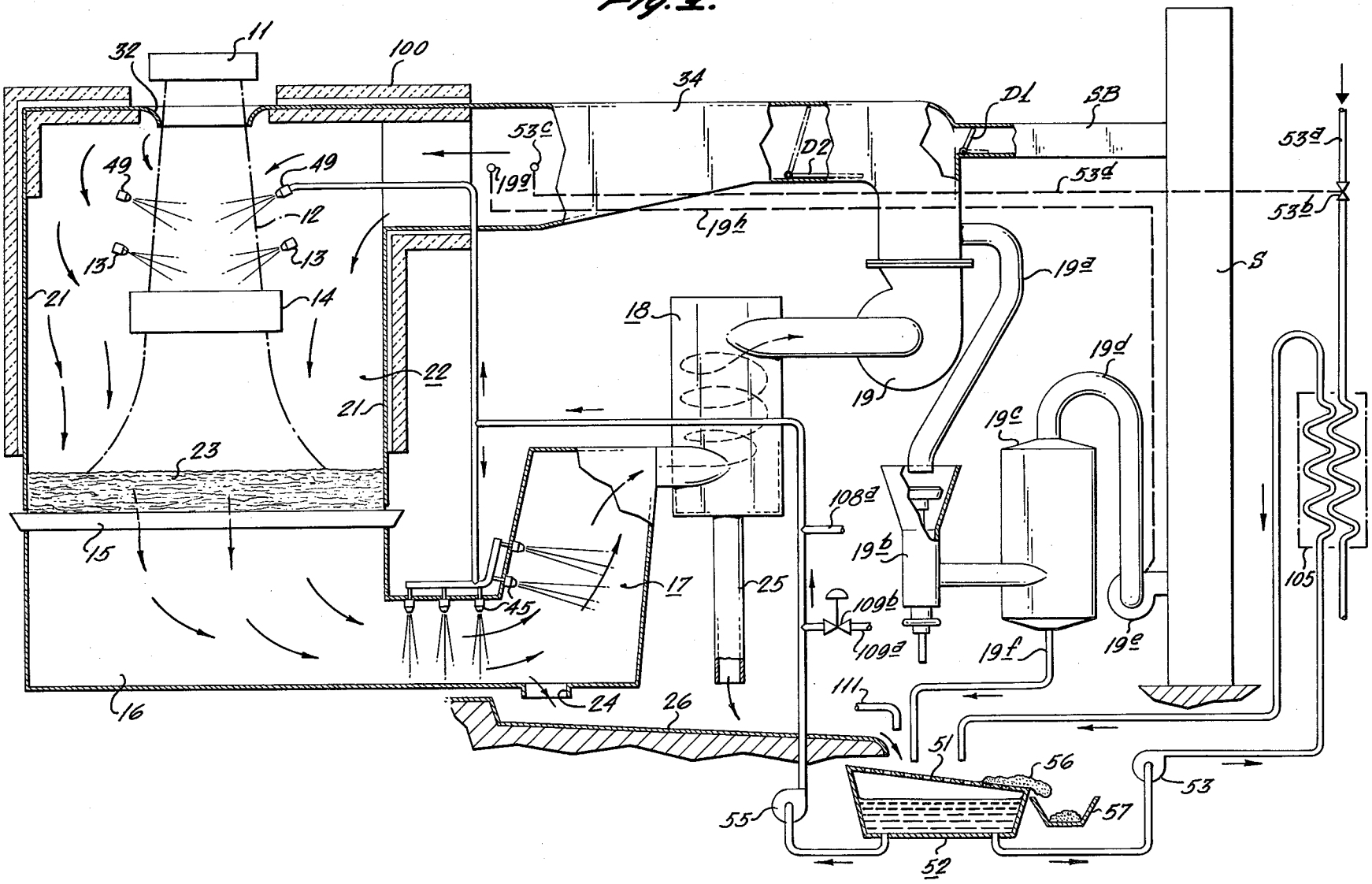
FIG. 1 is a schematic view of a fiber production installation having certain equipment associated therewith for suppression of pollutants in the manner disclosed in application Ser. No. 456,878 above referred to, and illustrating one embodiment of pressure and temperature controls according to the present invention.

Referring first to FIG. 1, there is diagrammatically represented a fiber production and collection installation including a fiber production device indicated at 11. This may take a variety of forms, such as a centrifuge, for instance as shown in the Levecque U.S. Pat. No. 3,285,723. It may also take the form of various other fiberization techniques, such as that disclosed in U.S. Pat. No. 3,874,886. In either event, and also in the event of using still other techniques for fiberization, the technique includes employment of attenuating gases which carry the attenuating and attenuated fibers downwardly into and through the chamber or forming section 22 which is defined by the enclosing walls 21, the current of the attenuating gas and fibers being indicated in the FIG. 1 at 12. Although in FIG. 1 the fiber production device 11 is shown at the top and the collection device at the bottom, other relationships may be employed.

Although the fiber forming equipment may be located within the chamber 22, as shown in FIG. 1 it is located just above the top wall 100 and delivers the current of the attenuating gas and the fibers downwardly into the chamber. If desiredd a centrally apertured closure 32 may be arranged around the current entering the chamber.

At the bottom of the chamber 22 a foraminous collecting device diagrammatically indicated at 15 is provided, this collecting device advantageously taking the form of a perforated endless conveyor on which the fibers are deposited, so as to build up a mat as indicated at 23, which is carried by the conveyor out of the zone of the forming section, as is well understood in this art. A fiber distributing device diagrammatically indicated at 14 may also be employed to assist in laying down a uniform blanket upon the conveyor 15.

As is indicated by arrows applied to FIG. 1, the attenuating blast entrains air or gases and the resultant current passes downwardly through the foraminous collecting device 15 and into the suction chamber indicated at 16. A suction fan 19 serves to provide forced circulation of the gas, and assists in establishing the current downwardly in the forming section so as to deposit the fibers on the collecting device 15 and draw the gas through this device and through the the washing chamber indicated at 17 and the cyclone separator 18. The exhaust or suction fan delivers the gases into the duct 34 which, as clearly appears in FIG. 1, is connected with the upper portion of the forming section or chamber 22, in the region in which the fibers are being introduced or attenuated. A recirculation of the gases is thus provided in the manner fully described in the application first referred to above. As described in that same application, a water spray, originating from nozzles 49 may be applied to the current in the upper portion of the forming section, and, in addition, a binder may be sprayed upon the current, for instance by nozzles indicated at 13.

The gases being drawn downwardly through the forming section, through the blanket 23 and the perforated collecting device 15, entrain substantial quantities of water and pollutants, and in order to remove pollutants the recirculating flow is subjected to a washing action by water spray nozzles indicated at 45, as the gases pass into the scrubber 17. Some of the water and pollutants will then drain or flow by gravity through the opening indicated at 24 into a collection or draining system 26 and ultimately into a sump 52. Droplets of moisture and pollutants which are not separated at this point flow with the recirculating gas into the cyclone separator 18, in which moisture droplets are separated and flow downwardly by gravity through the discharge 25 and then join the liquid in the sump 52. After separation of the liquids in this manner the gases are returned to the forming chamber as above described.

According to the prior application first referred to above, the water entering the sump 52 from the collecting system 26, is subjected to a screening operation by means of the screen diagrammatically indicated at 51 thereby straining out various solids, as indicated at 56, which solids may be received in the trough 57 for subsequent disposal, for instance after processing in the manner referred in the application first identified above. The liquid in the sump 52 is desirably cooled, for instance in the indirect heat transfer device indicated at 105, the liquid being delivered by the pump 53 through this heat transfer device, in heat exchange relation to a cooling liquid from the supply pipe 53*a*, for instance a normal water supply pipe. The cooled liquid is then returned to the sump 52.

Liquids may be withdrawn from the sump 52 by means of the pump 55 and delivered to the spray nozzles 49 and 45, as shown in FIG. 1, and if desired some water may be diverted through connection 108*a* and used in the formulation of additional aqueous binder spray material to be sprayed upon the fibers by nozzles 13, in the manner more fully explained in the application first referred to above.

Recirculating wash water which is sprayed upon the current of attenuating gases and fibers through the nozzles 49 will be subjected to considerable elevation in temperature, in consequence of which soluble organic constituents carried in the wash water will be in part insolubilized, so that upon subsequent passage of this water through the filtration and separation equipment, such as diagrammatically indicated at 51, some separation of additional solids will occur. More extensive insolubilization of the pollutant organic constituents in the wash water may be effected by diverting a portion of the wash water from the recirculation flow path beyond the pump 55, as by means of the branch 109*a*, having a valve 109*b*, as described hereinafter with reference to FIG. 5.

In the embodiment shown in FIG. 1, offtake 19*a* is provided for diverting and discharging a portion of the recirculating gases. This offtake delivers the diverted gases through a venturi separator of known type including adjustable venturi device 19*b* for increasing the velocity of the gases, and the separator 19*c*, from which the gases are withdrawn at the top through the connection 19*d* under the influence of the blower 19*e* which discharges into the stack S. The additional liquids separated in the separator 19*c* are delivered through a connection 19*f* back to the sump 52.

In the embodiment of FIG. 1 a bypass SB is also provided from the downstream side of the suction of circulating fan 19 to the stack, and this bypass desirably has a normally closed damper D1 therein. Similarly a normally open damper D2 is provided in the recirculation duct downstream of the point of connection of the bypass SB. The dampers D1 and D2 are provided for the purpose of bypassing the gas flow to the stack for instance in the event of a malfunction in the venturi separator equipment which is contemplated for normal use in this embodiment.

For pressure control in the embodiment of FIG. 1 it is contemplated to employ a pressure sensor 19*g* in the recirculation flow path close to or in the forming section, this sensor being provided with a control connection diagrammatically indicated at 19*h* which is extended from the sensor to the motor for driving the blower 19*e*. When the pressure device 19*g* senses increase in the pressure, the control system operates to increase the speed of operation of the motor for the blower 19*e*, thereby resulting in diverting and discharging a larger percentage of the recirculating gases. It is contemplated and preferred that this pressure sensor and the associated control system operate to maintain the pressure in the forming section substantially at atmospheric pressure, thereby avoiding tendency for substantial leakage of gases from or into the forming section, notwithstanding the operation of the recirculation system. In a system of the kind illustrated and described, the quantity of gases diverted and discharged will ordinarily approximate about 15% of the total of the gases entering the suction chamber 16, and in a typical installation the attenuating gases introduced by the fiber forming equipment and leaking into the suction chamber 16 also represent about 15% of the total gases flowing through the system.

The offtake 19*a* could be directly connected to the blower 19*e*, without the interposition of the venturi separator 19*b*–19*c*, and the pressure control system would still function in the manner described, but it is preferred to use a separator in this offtake in order to supplement the separation of pollutants effected by the scrubbing of the gas in the scrubber 17 and the separation of entrained moisture in the separator 18.

Turning now to the matter of temperature control, attention is first called to the fact that a valve 53*b* is provided in the cooling water supply line 53*a*. This valve is placed under the control of a temperature sensor 53*c* which is also positioned in the recirculation flow path near to or in the upper portion of the forming section 22. This sensor has a control connection indicated diagrammatically at 53*d* which is extended to and connected with the water supply valve 53*d*. The sense of this control is to increase the valve opening with increase in temperature in the recirculating gases and decrease the valve opening with decrease in temperature. By this system of control, the temperature of the water in the sump 52 is maintained substantially constant, so that the water used for spraying and scrubbing the gases in the scrubber 17, i.e., the water delivered to the spray nozzles 45, is also maintained substantially constant. This control of the water temperature will in turn control the temperature of the recirculating gases and, when operation of the system is established and stabilized, deviation of temperature of the recirculating gases from a predetermined median value will result in a compensating change in the temperature of the water used for scrubbing the gases, thereby compensating for gas temperature fluctuation.

The arrangement of FIG. 1 thus provides for both temperature and pressure control, and thereby assures maintenance of uniform operating conditions in the zone of fiberization and blanket formation in the forming section.

It is contemplated that the controls be established in a manner maintaining a pressure within the forming section very close to atmospheric pressure. Thus, the pressure sensor and the control system for adjusting the speed of operation of the blower or fan 19*e* will operate to divert and discharge that quantity of the total recirculating gases which is represented by newly introduced attenuating gases and leakage of air. For accurate maintenance of the desired pressure, the offtake for diverting and discharging a portion of the gases from the recirculation flow path is desirably connected with the ducting downstream of the suction fan or blower 19, but upstream of the forming section. Maintenance of the pressure in the forming section at atmospheric pressure is desirable in order to avoid leakage of gases from the forming section into the surrounding atmosphere, and also to avoid leakage of air into the forming section.

Figure 2:
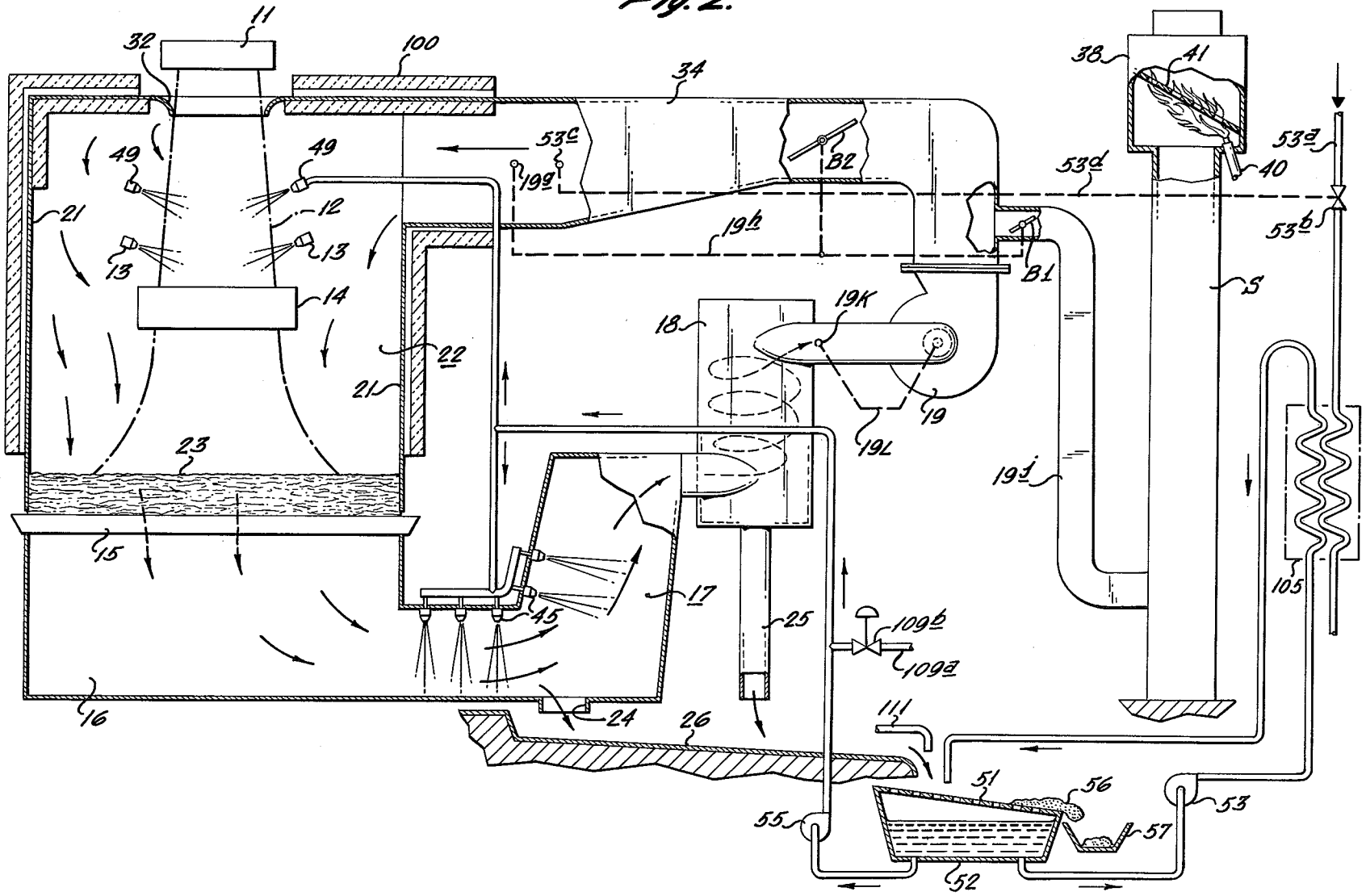
FIG. 2 is a view similar to FIG. 1 but illustrating another embodiment of the pressure control system.

Turning now to the embodiment illustrated in FIG. 2, it is first noted that the forming section and associated devices are illustrated in the same manner as in FIG. 1, and that the various parts are identified by the same reference numerals. Moreover, the embodiment of FIG. 2 illustrates the same temperature control system, including the direct heat exchanger 105, the cooling water supply line 53*a*, and the supply controlling valve 53*b* which is operated under the influence of the temperature sensor 53*a*.

However, the pressure control system shown in FIG. 2 is different from that shown in FIG. 1. In FIG. 2 an offtake 19*j* is connected with the recirculation flow path at a point between the fan 19 and the forming section, and this offtake 19*j* is directly connected with the stack S. The offtake 19*j* is provided with a control valve, for instance a butterfly type of valve indicated at B1. In addition a similar butterfly control valve B2 is located in the ducting 34 extended from the blower 19 to the forming section.

The two butterfly control valves B1 and B2 are both controlled by the pressure sensor 19*g*, a control connection being provided as diagrammatically indicated at 19*h*. The control valve B1, being located in the offtake 19*j*, regulates the quantity of the gases diverted from the recirculation flow path. However, accuracy of pressure control in the forming section requires also that the butterfly control valve B2 in the ducting be operated simultaneously with the valve B1. The manner of operation of these valves under the influence of the sensor 19*g* is as follows. When the sensor 19*g* experiences an increase in pressure, the position of the valve B2 is shifted to decrease the opening for the recirculating gases, and at the same time the position of the valve B1 is adjusted to increase its opening. This results in tendency to equalize or stabilize the pressure of the recirculating gases in or entering the forming section. Although, for maximum accuracy of pressure control, it is preferred to use both of valves B1 and B2, it is also possible to approximate the desired control by employment of valve B2 only.

In the embodiment of FIG. 2, instead of employing a separator of the type indicated at 19*b* and 19*c* in FIG. 1, the offtake 19*j* is connected directly to the stack S, as noted above. Where pollution restrictions are particularly stringent, a system such as shown in FIG. 2 preferably further embodies a burner device indicated diagrammatically at 38, this device being provided with a burner 40 supplied with a combustible mixture and provided with a grid 41 or any other suitable flame stabilization device. The portion of the gases or fumes diverted and discharged are passed through this burner device 38 and are subjected to high temperature, preferably between about 600° and 700° C, to thereby burn any organic constituents remaining before discharge of the diverted gases to atmosphere. A temperature of from about 300° to 400° C may be used in the presence of a combustion catalyst.

The employment of the burner 38 in a system such as diagrammatically illustrated in FIG. 2 is effective to reduce the pollutants in the discharged gases to a very low value.

In FIG. 2 there is also disclosed a control for the flow or volume of the gases in the recirculation system. Thus, a flow sensor 19K is arranged in the connection between the separator 18 and the suction fan 19, and this sensor is connected as indicated at 19L with the motor for the suction fan 19. The sensor is connected with the motor in a manner to provide for decrease in the motor speed when the sensor experiences an increase in the flow, and for an increase in motor speed when the sensor experiences a decrease in flow. Although this flow control may not always be required, it will serve to further stabilize the operating conditions in the forming section.

Figure 3:
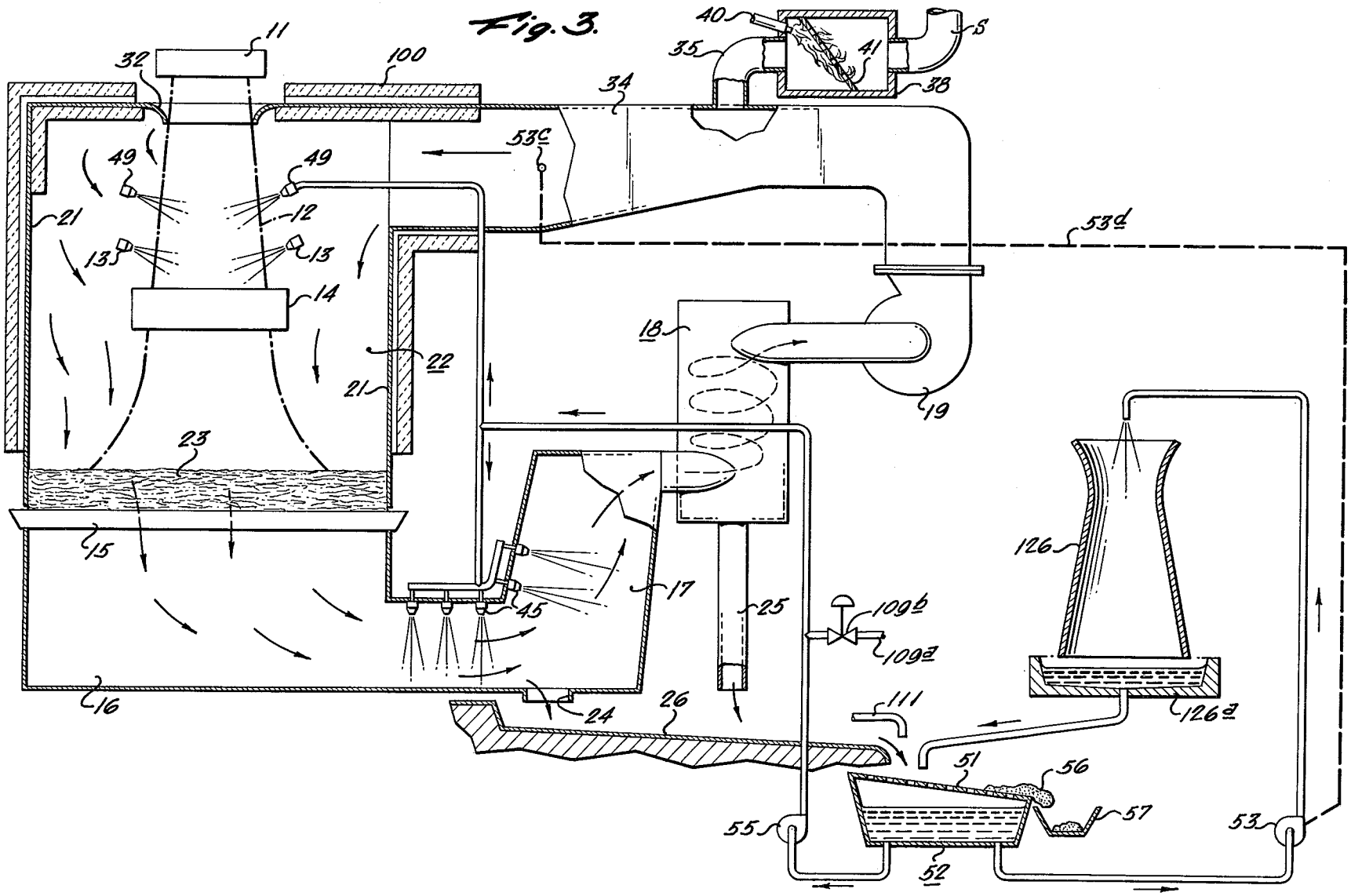
FIG. 3 is a view similar to FIG. 1 but illustrating another embodiment of the temperature control system.

Turning now to the embodiment illustrated in FIG. 3, it is noted that here again the portion os the system comprising the forming section and associated parts are the same as those described above in connection with FIGS. 1 and 2.

In the system of FIG. 3, however, there is disclosed an alternative arrangement for cooling the water used to spray and cool the recirculating gases. In this embodiment a spray cooling tower 126 is utilized for cooling the water circulated through the sump 52. The water is withdrawn from the bottom of the sump by the pump 53 which delivers the water through a spray nozzle into the cooling device 126 for direct heat transfer to the air. The water is collected at the bottom of the tower as at 126*a*, and is then returned to the sump 52 as indicated. In this arrangement the temperature is controlled by a sensor 53*c* having control connections 53*d* extended to the motor for the pump 53, thereby regulating circulation of the water through the spray tower 126. When the temperature sensor 53*c* experiences a drop in temperature below the desired median value, the speed of the pump 53 is reduced, thereby diminishing the water cooling effect of the tower 126. In consequence of this the water sprays 45 and 49 will deliver water at a somewhat higher temperature and will therefore not cool the recirculating gases to the same extent.

This embodiment provides an exceedingly simple temperature regulation system and may be used in installations where the quantity of pollutants remaining in the filtered water in the sump 52 is not very high, and will therefrom not result in any extensive atmospheric pollution as a result of spraying the water in the tower 126. The system of FIG. 3 also incorporates an offtake 35 for diverting and discharging a portion of the recirculating gases. As here shown the offtake is provided with a burner device 38 of arrangement similar to that described above in connection with FIG. 2.

As will be understood, a system such as shown in FIG. 3 may also incorporate a pressure control system, for instance a system as disclosed in FIG. 1 or FIG. 2, and described above.

Likewise, although the apparatus in FIG. 1 and 2 includes systems for both pressure and temperature control according to the invention, either one of these systems may be used alone.

In the embodiment of FIG. 4, the forming section and various other parts shown in the preceding figures bear the same reference characters. FIG. 4 shows a fiberization installation similar to that described in application Ser. No. 557,281 above referred to, comprising principal gaseous current or blast generators 154, 156 and 158 and also secondary or carrier jet generators 148, 150 and 152 placed in a forming section 22.

As described in U.S. Pat. No. 3,874,886, each secondary gaseous jet, by penetrating the principal current, creates a zone of interaction into which is led a stream of thermoplastic material such as molten glass, thereby effecting attenuation of the glass by the process known as toration. The glass is supplied from the orifices in the bushings 142, 144 and 146, fed by the forehearths 136, 138 and 140.

It is preferable to use in combination with each principal current a plurality of secondary jets and a plurality of glass streams are led into each principal current, each being associated with a secondary jet, which provides groups of fiberization centers for each principal current generator. The fiberization centers formed by the various groups of generators deliver attenuated fibers into a guide 168, 170 or 172. The guides comprise channels directing the fibers downwardly, with relation to the fiberization zone, delivering the fibers onto the foraminous blanket forming device or conveyor 15 which is located at the bottom of forming section 22. The gases delivered from the blast generators and from the secondary jets flow with the fibers into the guides and form with the fluids which they induce the currents of gas and fibers illustrated at 12.

The suction chambers 16 placed under the perforated conveyor 15 provide for lay down of the fibers in the conveyor. These suction chambers communicate with the cyclone separators 18 each connected to an exhaust fan 19 which drives the gases into the recycling duct 34 as described in connection with the preceding figures. This duct comprises a portion of the gas recycling path; it is connected to an end of the fiber forming chamber 22, and with guiding partitions 132 provides uniform distribution of the recycled gases in the said chamber.

The gases and fibers are cooled as soon as they leave the guides 168, 170 and 172 by water delivered from nozzles or sprayers 49 preferably arranged both above and below the currents 12 of the attenuated fibers and the gases. The spraying nozzles 13 are used for spraying the binder, the nozzles 13 being located downstream of the nozzles 49.

As specified above, the gases entering the suction chambers contain resinous components from the binder, and moisture and small debris from fibers, and these constituents are extracted from the gases in the cyclone separators 18. This separation is enhanced by the previous washing of the gases by the water sprayers 45 placed inside the suction chambers 16. The water and the polluting elements discharged through the tubes 25 accumulate in the sump 103. After this separation the gases are recycled to the forming section or chamber 22.

The general flow of the gases in the recycling path is illustrated by the arrows 29. In the forming section 22 the gaseous flow is established primarily by the evacuation fans 19 but is reinforced by the action of the principal current or blast and of the carrier jets in the fiberization centers. A portion of the recycled gases enters the upper ends of the guides and other portions are led toward the gas and fiber currents 12 beyond the discharge ends of the guides.

The water and the polluting elements recovered in the sump 103 are delivered by pump 104 and to the sump 52 which is provided with a filter or sieve 51. The gathered liquid in the sump is sent by means of the pump 53 through the heat exchanger 105 to be cooled. The heat exchange is effected in two stages by means of a fluid of heat carrier which circulates by pump 107 through the cooling system 126. This is comprised, for example, of a cooling tower in which water from a normal water supply source is circulated by the pump 107 and is brought into contact with the atmospheric air. The cooled liquid in the exchanger 105 is then sent to the pump 52.

The liquid withdrawn from the sump 52 by the pump 55 can be reused as already pointed out in the description relating to FIG. 1 and the withdrawn portion is eventually submitted to the insolubilization treatment of the polluting organic constituents.

Make-up water can be introduced into the system by way of the feed connection 111 delivering to the sump 52.

A discharge duct 35 extended from the upper part of the forming section or chamber is used to discharge a portion of the gases from the said chamber under the influence of the fan 44. The gases thus emitted are led into a burning apparatus 39 in which the temperature is raised, as described for FIGS. 2 and 3, preferably to a value at least equal to 600° C. Here again, the quantity of gases directed and treated in the burning apparatus can be about 5% of the total quantity of gas flowing through the perforated conveyor 15.

The pressure control in this installation is effected by a pressure sensor **19*g* placed in the formation chamber and connected to the operating motor for the fan 44 by means of the control connection schematically illustrated at 19*h*. The operation of this system is similar to that described for FIG. 1. When the pressure sensor 19*g* detects a rise in pressure, the control system effects an increase of the speed of the fan 44, which increases the quantity of gas discharged through the duct 35**.

For temperature control a valve **53*b* is used, placed in the path in which the cooling fluid circulates through the cooling system 126**.

The valve **53*b* is connected, by means of a control connection schematically illustrated at 53*d*, to a temperature sensor 53*c* placed in the forming chamber 22, preferably in its upper part. When the temperature sensor detects an increase in temperature of the gases in the forming chamber, the regulation system effects opening of the valve 53*b*, which initiates an increase of the circulation of the heat carrier liquid and increases the cooling action in the heat exchanger 105, and conversely when the temperature decreases in the forming chamber the cooling action is diminished. This temperature control of the water coming from the sump 52 and sprayed by the sprayer nozzles 45 and 49** controls in turn the temperature of the recycled gases and consequently that of the forming section or chamber.

The pressure and temperature control devices illustrated in FIGS. 1 and 2 as well as the discharge duct **19*a* or 19*j* for the non-recycled gases, and various of the separation devices such as electrofilters, can be used in the same general way in the installation shown in FIG. 4 instead of offtake 35**.

As hereinabove mentioned, and as fully explained in the prior application first identified above, the recirculating wash water is desirably subjected to further purification, expecially by treatment of the wash water at elevated temperature in order to convert water soluble pollutant constituents to an insoluble form. This is desirably accomplished as proposed in said prior application either batch-wise or continuously and in either event the treatment may be carried out in a manner to withdraw a portion only of the water from the recirculation flow path and then return the treated portion to the sump 52. A continuous system for this purpose is illustrated diagrammatically in FIG. 5. In the bottom central portion of this figure the connection 109*a* is indicated. This connection as mentioned above constituting a valved branch for diverting a portion of the water from the recirculation flow path. The water to be treated is delivered from this connection 109*a* to a mixer 78 in which an injector 79 is arranged, through which the heating fluid consisting of steam is introduced. This steam mixes with the water to be treated and, upon condensing, transmits heat to this water. The steam flow is regulated by motorized valve 80 controlled by regulator 81, in order to maintain the desired treatment temperature at the outlet of mixer 78. Subsequent to leaving mixer 78 in which it had remained for 10 seconds, the water to be treated passes through a reactor 82, where insolubilization of the binder takes place the dimensions of which are adjusted so that the retention time of the water to be treated corresponds to the duration of treatment, for instance 2 to 4 minutes at a temperature of 200° C.

Subsequent to leaving the reactor, the water is cooled in an exchanger 83, to a temperature less than 100° C., and preferably from 40° to 50° C. Some of this cooling is provided by the water to be treated, which is thus preheated in coil 84 for instance, from approximately 40° C. to approximately 80° C. The rest of the cooling is provided by a cooling fluid circulating in coil 85.

Subsequent to leaving exchanger 83, the treated and cooled water is decompressed to atmospheric pressure through a pressure-reducing valve 86 which, controlled by a regulator 87, maintains the treatment pressure in the installation.

The decompressed water flows towards the filtration device 51, or a flocculation-decantation or centrifuging device, which separates the binder insolubilized by the treatment of the treated water. The filtered water returns to sump 52 and the solid wastes 56--residues of the treatment--are delivered to the conveyor 57.

EXAMPLES

Glass fibers were made in accordance with the techniques illustrated in FIG. 1.

Water was sprayed on the fibers through nozzles 49 and binder resin material was sprayed on the fibers through nozzles 13.

The binder resin material was a 10% aqueous solution of the following (solids indicated by weight parts):

| | |
|---|---|
| Phenol formaldehyde (water soluble resol type) | 50 |
| Urea | 40 |
| Emulsified Mineral oil | 7 |
| Ammonium sulphate | 3 |

In spraying the binder material on the fibers, the binder material was subjected to a temperature of about 300° C,, resulting in volatilization of some constituents of the binder material. Such volatilized constituents were entrained by the circulating gases and were washed from the gases by the wash water in which these constituents were suspended or dissolved.

The wash water was found to contain 2.5% of solids. Of these solids about 0.2% was represented chiefly by broken fibers and already insolubilized binder resin; and about 2.3% was represented by soluble constituents of the binder resin material, chiefly phenol (1.5%) and formaldehyde (0.4%).

The soluble constituents just mentioned were subjected to insolubilization by treatment at elevated temperature, in the general manner described above with reference to FIG. 5. Thus, a temperature of about 200° C. was maintained for an interval of a few minutes and the water was then cooled. After this treatment about 70% of the soluble constituents were insolubilized. The insolubilized constituents were then filtered from the water.

In consequence of the treatment of this example, the solids content of the wash water was brought down to about 0.7%, which is satisfactory for reuse in the system.

After separation of the wash water, most of the gases were recirculated to the fiberization zone. However, a portion of the gases were withdrawn from the recirculation path and in accordance with FIG. 1 were passed through a venturi separator and were discharged to the stack. The gases delivered to the venturi separator contained a residual quantity of the pollutants and the venturi separator removed from about 60% to 70% of the residual pollutants before discharge of the gases from the stack.

In another example, the operation was carried out in the same manner as described above, but instead of delivering the withdrawn gases through the venturi separator, the withdrawn gases were delivered through a burner chamber prior to discharge from the stack as in the manner illustrated in FIG. 2. In this case, the efficiency of the burner was close to 100%, i.e., it eliminated virtually all of the pollutants from the gas discharged to the atmosphere.

Numerous other fiber binders including melamine formaldehyde, urea formaldehyde, dicyandiamide formaldehyde resins and also bitumen are useable in techniques as described in the example above.

We claim:

1. A process for manufacture of fibers comprising forming fibers by gas blast attenuation of attenuable material, establishing a current of the attenuating gas and the attenuated fibers in a forming section having a foraminous fiber collecting device at a boundary of the forming section through which the gas of said current passes and on which the fibers collect to form a blanket, subjecting the gas to forced recirculation through a recirculation path extended from the downstream side of the collection device to the forming section, diverting and discharging a portion of the gas from said recirculation path, the discharge being effected by forced gas discharge, replenishing the current by adding new attenuating gas, and regulating the pressure in the forming section by sensing the gas pressure and by varying the force of discharge from the recirculation system in accordance with the sensed pressure.

2. A process for manufacture of fibers comprising forming fibers by gas blast attenuation of thermoplastic material, establishing a current of the attenuating gas and the attenuated fibers in a forming section having a foraminous fiber collecting device at a boundary of the forming section through which the gas of said current passes and on which the fibers collect to form a blanket, subjecting the gas to forced recirculation through a recirculation path extended from the downstream side of the collection device to the forming section, diverting and discharging a portion of the gas from said recirculation path, the discharge being effected by forced gas discharge, replenishing the current by adding new attenuating gas, and regulating the pressure in the forming section by sensing the gas pressure and by varying the force of discharge from the recirculation system in accordance with the sensed pressure.

3. A process as defined in claim 2 in which the pressure in the forming section is maintained substantially at atmospheric pressure.

4. Apparatus for manufacture of fibers comprising fiberizing means for effecting gas blast attenuation of attenuable material, a forming section having a foraminous fiber collecting device at a boundary thereof, means for establishing a current of the attenuating gas from the fiberizing means through the foraminous collecting device and providing for formation of a fiber blanket on the collecting device, means for recirculating gas of said current in a recirculation path from the downstream side of the foraminous collecting device to the forming section, means for separating pollutants from the recirculating gas, and means for acting to maintain the pressure in the forming section substantially constant comprising a gas offtake for diverting and discharging a portion of the gas, a pressure sensor responsive to the pressure of the gas being delivered into the forming section, and an adjustable blower controlled by said sensor and regulating the amount of gas discharged from the gas offtake.

5. Apparatus as defined in claim 4 in which the gas offtake communicates with the recirculation flow path.

6. Apparatus as defined in claim 4 in which the gas offtake communicates with the forming section.

7. Apparatus as defined in claim 4 and further including means for separating pollutants from the gas being discharged.

8. Apparatus as defined in claim 7 in which the means for separating pollutants comprises a moisture separator.

9. Apparatus as defined in claim 4 and further including a burner through which the gases are discharged and providing for burning of organic constituents carried by the gas being discharged.

* * * * *